US006956956B2

(12) United States Patent
Kuratani et al.

(10) Patent No.: US 6,956,956 B2
(45) Date of Patent: Oct. 18, 2005

(54) SPEAKER INSTALLATION AND METHOD

(75) Inventors: Tomoaki Kuratani, Shizuoka (JP); Kosuke Takata, Shizuoka (JP)

(73) Assignee: Roland Corporation, Osaka (JP)

( * ) Notice: Subject to any disclaimer, the term of this patent is extended or adjusted under 35 U.S.C. 154(b) by 162 days.

(21) Appl. No.: 10/385,089

(22) Filed: Mar. 10, 2003

(65) Prior Publication Data

US 2004/0017924 A1 Jan. 29, 2004

(30) Foreign Application Priority Data

Mar. 11, 2002 (JP) ..... 2002-064923
Oct. 30, 2002 (JP) ..... 2002-316712

(51) Int. Cl.[7] ..... H04R 1/00
(52) U.S. Cl. ..... 381/397; 381/345
(58) Field of Search ..... 381/397, 343, 381/335, 345, 166, 386, 396, 393, 124, 349; 181/198, 199, 148, 155, 156; 361/367, 368, 361/681, 682, 683, 684, 685, 686

(56) References Cited

U.S. PATENT DOCUMENTS 3,778,551 A * 12/1973 Grodinsky ..... 381/335
3,952,159 A * 4/1976 Schott ..... 381/349
5,696,357 A * 12/1997 Starobin ..... 181/156
6,215,655 B1 * 4/2001 Heady et al. ..... 361/683
6,504,938 B1 * 1/2003 Anderson et al. ..... 381/335

FOREIGN PATENT DOCUMENTS

JP 63074297 A * 4/1988 ..... H04R 1/02
JP 04045699 A * 2/1992 ..... H04R 1/28
JP 2001-346283 12/2001

* cited by examiner

*Primary Examiner*—Curtis Kuntz
*Assistant Examiner*—Brian K Ensey
(74) *Attorney, Agent, or Firm*—Foley & Lardner LLP

(57) ABSTRACT

A speaker system in which it is possible for power amplifier heat radiation and satisfactory audio characteristics to coexist. The power amplifier, and other components which are sources of heat, are arranged in an air flow convection path that is formed in a curved path from a lower bass reflex port toward an upper bass reflex port of a speaker box. The heat is exhausted (radiated) to the outside from the interior air space of the speaker box by the air flow and air from outside is introduced into the interior air space with good efficiency. In addition, the power amplifier includes a heat sink. The heat sink includes gaps that are formed between each of a plurality of fins which are opened in a vertical or diagonal direction such that the air flow convection path passes through the gaps.

63 Claims, 6 Drawing Sheets

SPEAKER INSTALLATION AND METHOD

CROSS-REFERENCE TO RELATED PATENT APPLICATIONS

This application is based upon and claims the benefit of priority from the prior Japanese Patent Application No. 2002-316712 filed Oct. 30, 2002 and Japanese Patent Application No. 2002-64923, filed Mar. 11, 2002, the entire contents of each of which are incorporated herein by reference.

BACKGROUND OF THE INVENTION

1. Field of the Invention

The present invention relates generally to a speaker system and, in particular, relates to a speaker system in which both the heat radiation of the power amplifier and satisfactory acoustic characteristics can coexist.

2. Description of Related Art

For some time, speaker systems in which a speaker is mounted in a speaker box having an interior air space formed therein have been known. These speaker boxes may have an opening for heat radiation provided in the front surface of the speaker box. The opening allows the heat that is generated by the speaker to be exhausted to the outside of the speaker box. With this kind of speaker system, because an opening for heat radiation is provided in the uppermost portion of the speaker box, it is possible for the air that is warmed and rises to be exhausted (radiated) from the opening to the outside of the speaker box with satisfactory efficiency. An example of such a speaker system is disclosed in Japanese Unexamined Patent Application Publication (Kokai) Number 2001-346283 (See, for example, paragraph 0017, FIG. 1.)

In those cases where the speaker that has been mounted in a speaker box that has an interior air space formed therein is driven by a power amplifier, speaker systems that have the power amplifier deployed in the interior air space of the speaker box are preferred. This is because of carrying convenience and the like.

However, a considerable amount of heat is produced by the power amplifier when the speaker is driven. This heat, if it is confined within the box, can undesirably cause failures or faulty operation of the speaker. In this case, as has been disclosed in the above-mentioned reference, the heat can, to some extent, be radiated to the outside by providing an opening for heat radiation in the speaker box.

However, the technology that is disclosed in the above-mentioned reference has as its aim the exhausting of the heat that is produced by the speaker to the outside of the speaker box. The radiation of the heat that is produced by a power amplifier is not even considered. Because of that, in those cases where an amplifier has been deployed in the interior air space of the speaker box, there is a problem in that the heat radiating ability is insufficient and the heat cannot be fully radiated. As a result, there have been failures and faulty operation of components in the speaker box. In addition, it has been difficult to satisfy the temperature requirements that are prescribed by the safety standards of various countries.

It is possible to improve the design of the speaker box to increase the heat radiating ability, for example, by making the area of the opening larger. However, in those cases where the area of the opening is made unreasonably large, the acoustic characteristics of the speaker system are impaired.

In addition, the user may come in contact with high temperature electronic circuits by, for example, reaching through the opening. This creates an unsafe condition for the user.

SUMMARY OF THE INVENTION

Embodiments of the present invention address the problems that have been described above by providing a speaker system with which it is possible for both the heat radiation of a power amplifier and satisfactory acoustic characteristics to coexist.

According to one embodiment of the present invention, a speaker system is provided which comprises a speaker box defining an interior air space and having at least a first surface and a second surface. The speaker system further comprises a speaker arranged within the interior air space. At least one air inflow port on the first surface provides an opening to outside of the speaker box from the interior air space. At least one air outflow port on the second surface provides an opening to outside of the speaker box from the interior air space. A heat producing component such as an amplifier is arranged relative to the speaker within the interior air space such that air entering the interior air space from outside the speaker box via the at least one air inflow port is directed towards the heat producing component to cool the component. Furthermore, heat radiated from the heat producing component rises above the speaker in the interior air space before exiting to outside the speaker box via the at least one air outflow port, thus efficiently dissipating heated air from the speaker box.

According to another embodiment of the present invention, a speaker system is provided which comprises a speaker box defining an interior air space and a speaker arranged within the interior air space. At least one air inflow port in the speaker box provides an opening to outside of the speaker box from the interior air space. At least one air outflow port in the speaker box provides an opening to outside of the speaker box from the interior air space. The at least one air inflow port and the at least one air outflow port are arranged in the speaker box such that an air flow path through the speaker box is formed. A heat producing component such as an amplifier is arranged within the interior air space such that the heat producing component is within the air flow path and is thereby cooled.

The amplifier may be in contact with a heat sink to further dissipate heat generated by the amplifier. The heat sink may comprise a plurality of fins functioning as an expanded heat transmission surface of the heat sink. Ones of the plurality of fins may be arranged standing mutually parallel with, and separated by a specified interval from, adjacent ones of the plurality of fins. In this manner, gaps are formed between opposing faces of the plurality of fins. Each of the gaps expose a portion of a bottom side surface of the heat sink and two side surfaces of the plurality of fins to surrounding air, thus dissipating heat from the heat sink. The heat sink may be oriented within the speaker box such that the air flow path passes through the gaps in two exposed side surfaces of the plurality of fins.

The at least one air inflow port and the at least one air outflow port may be bass reflex ports and acoustic characteristics of the speaker system may be tuned using at least one of the at least one air inflow port and the at least one air outflow port. The acoustic characteristics of the speaker system may be tuned by changing an inner diameter and a length of at least one of the at least one air inflow port and the at least one air outflow port.

These and other features and advantages of embodiments of the invention will be apparent to those skilled in the art from the following detailed description of embodiments of the invention, when read with the drawings and appended claims.

DETAILED DESCRIPTION OF EMBODIMENTS OF THE INVENTION

In the following description of embodiments of the invention, reference is made to the accompanying drawings which form a part hereof, and in which is shown by way of illustration specific embodiments in which the invention may be practiced. It is to be understood that other embodiments may be utilized and structural changes may be made without departing from the scope of embodiments of the present invention.

As discussed above, the present invention relates generally to a speaker system and, in particular, relates to a speaker system in which both the heat radiation of the power amplifier and satisfactory acoustic characteristics can coexist.

Figure 1:
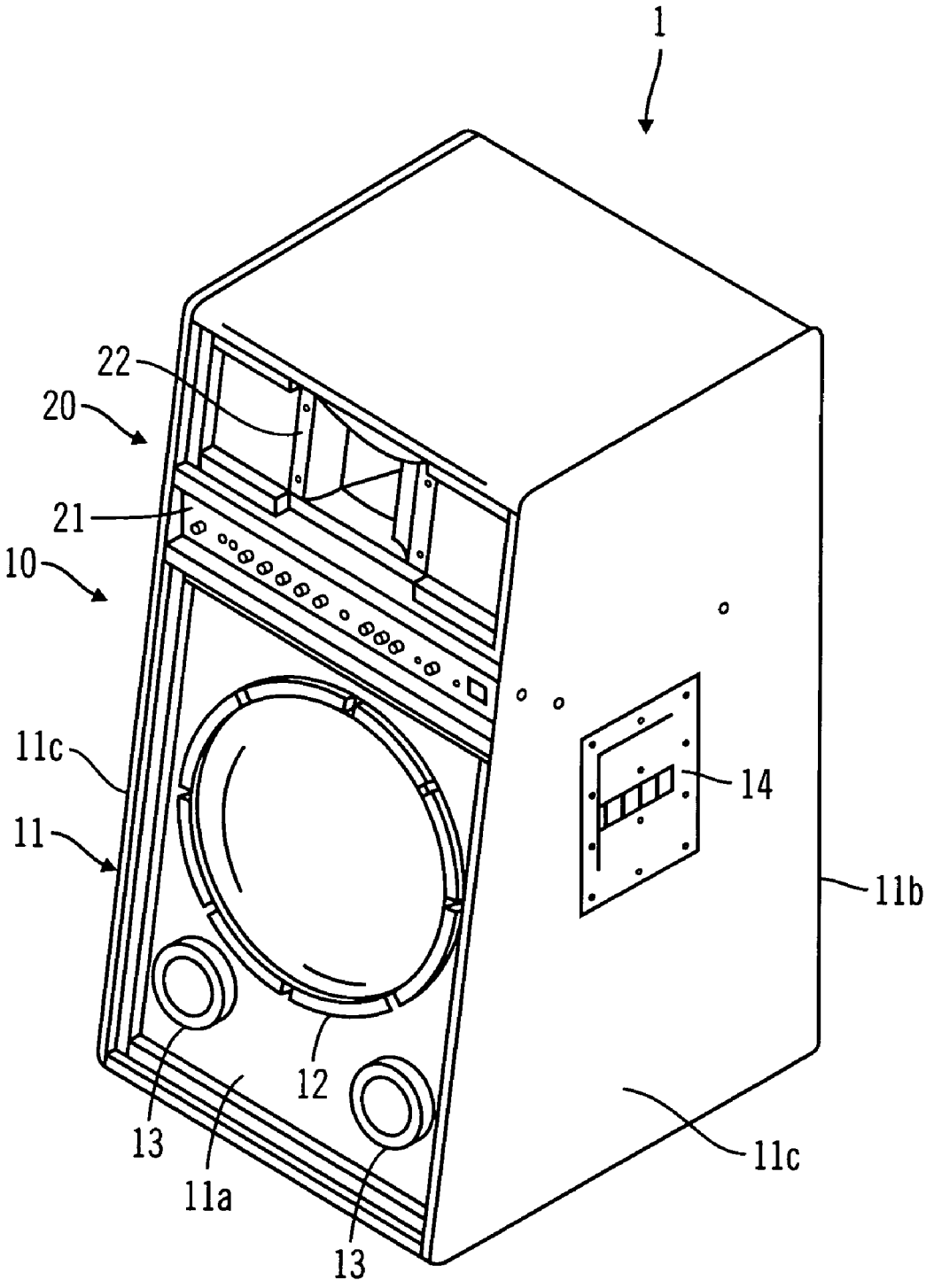
FIG. 1 is an exterior oblique view of a first preferred embodiment of the present invention viewed from diagonally above the front surface of the speaker system.

FIG. 1 is an exterior oblique drawing of a first preferred embodiment of the present invention viewed diagonally from above the front surface of the speaker system 1.

A speaker system 1, shown in FIG. 1, is a speaker system for use with, for example, an electronic percussion instrument and includes a woofer section 10 and a tweeter section 20. The first preferred embodiment of the present invention is employed with the woofer section 10. The woofer section 10 includes a speaker box 11 that defines an interior air space. The speaker box 11 comprises a slanted surface 11*a* that faces somewhat diagonally upward, rear surface 11*b* that faces in the direction of the slanted surface 11*a*, and right and left side surfaces 11*c*. A power amplifier (FIG. 3) is arranged in the interior air space. The slanted surface 11*a* forms a front surface of the woofer section 10 of the speaker system 1. A woofer 12, which reproduces primarily the low frequency musical sounds, is located in a portion of the slanted surface 11*a* that is slightly above the vertical center of slanted surface 11*a*. In addition, bass reflex ports 13, which provide openings to the outside from the inside of the speaker box 11, are arranged on both right and left edges of the slanted surface 11*a* below the woofer 12.

The acoustic characteristics of the woofer section 10 are tuned by means of the two bass reflex ports 13. The number of bass reflex ports 13 may be changed in accordance with the desired acoustic characteristics and, according to embodiments of the present invention, may be one or more, for example three. On each of the right and left side surfaces 11*c*, finger holds 14 are provided so as to make it convenient to lift and carry the speaker system 1. Each of the right and left side surfaces 11*c* may be formed such that they extend above an upper surface, as shown in FIG. 1.

The tweeter section 20 is arranged on top of the speaker box 11, adjoining the speaker box 11. A preamplifier ("preamp") (not shown) is deployed in the interior of the tweeter section 20. In addition, a control panel 21, by means of which the settings for the preamp and for the power amplifier are adjusted, is deployed on a bottom front surface area of the tweeter section 20. Furthermore, the tweeter 22, which primarily reproduces the high frequency sounds, is deployed in the center of a front surface of the tweeter section 20 above the control panel 21. The tweeter 22 is deployed in an uppermost portion of the speaker system 1 and is deployed in the optimum location for the drum player. In other words, the height of the location where the tweeter 22 has been deployed is a height that is as close as possible to the height at which the electronic cymbals are arranged in an actual drum set. This enables a drum player to monitor the electronic cymbal performance in a similar manner to when an acoustic cymbal has been struck.

Figure 2:
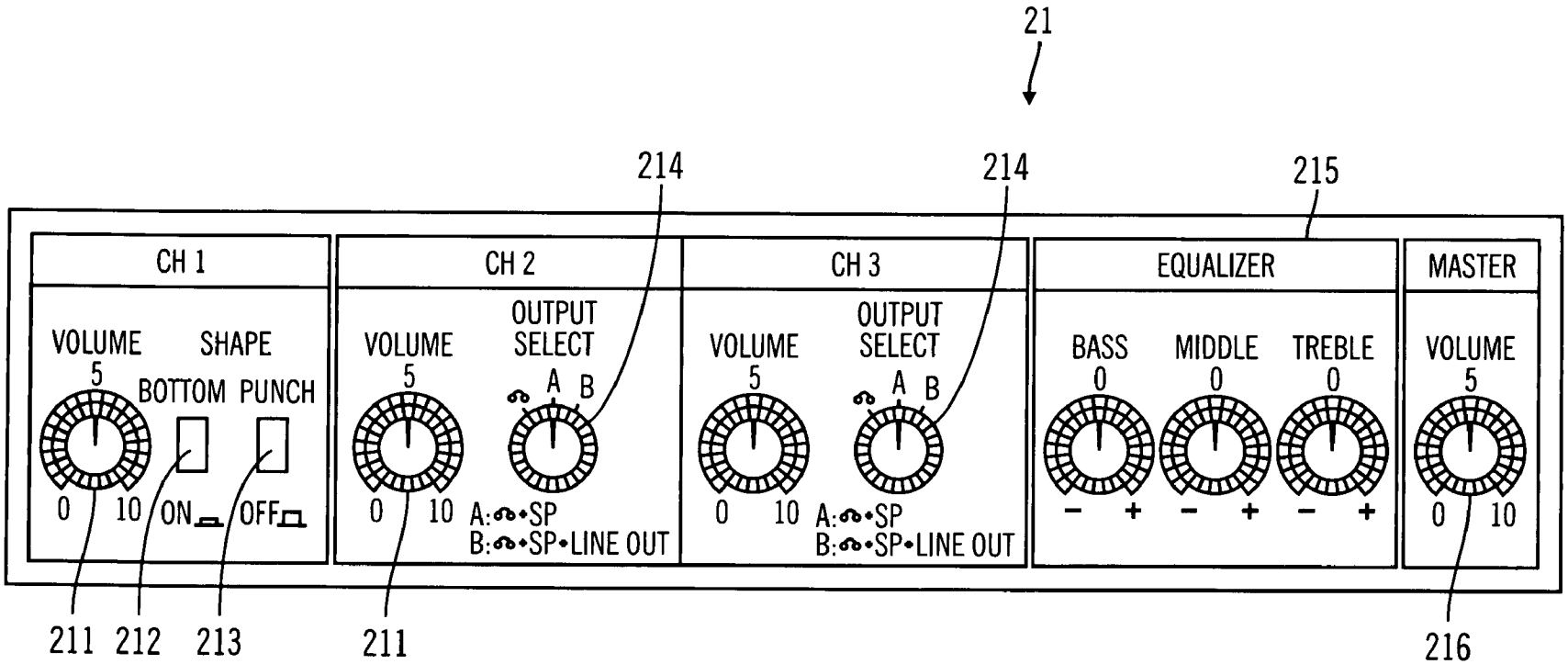
FIG. 2 is a front elevation of a control panel with which the speaker system that is shown in FIG. 1 is furnished, according to embodiments of the present invention.

FIG. 2 is an enlarged view of the control panel 21 of the speaker system 1 that is shown in FIG. 1, viewed from the front of the speaker system 1. The speaker system 1 that is shown in FIG. 1 has three input channels, channel 1, channel 2 and channel 3. The musical tone signals, which are input to each of these input channels, are mixed by the power amplifier and emitted as actual sounds into the room from the woofer 12 and the tweeter 22. Among these channels, channel 1 is a channel that is exclusively for the input of the musical tone signals that have been produced by a performance on the electronic percussion instrument. Channels 2 and 3 are channels for the input of other more general musical tone signals.

As shown in FIG. 2, dedicated operators are provided to adjust parameters of the speaker system 1. For example, dedicated operators are provided for the three channels on the left side (facing the control panel 21). Dedicated volume adjustment operators 211 are deployed for all of the channels. Operators 211 enable adjustment of the volume of the sound reproduced based on the musical tone signals that have been input for each channel.

In addition, bottom operator 212 and punch operator 213 are provided as shaping operators. Bottom operator 212 and punch operator 213 determine the respective low frequency and high frequency tone qualities for the reproduced sounds based on the musical tone signals that have been input to channel 1. When the bottom operator 212 is selected, it imparts the characteristics of the low frequency tone quality of the reproduced sound. When the punch operator 213 is selected, it imparts the characteristics of the high frequency tone quality of the reproduced sound.

Furthermore, output destination selection operators 214 are provided. Output destination selection operators 214 select output destinations for the output signals based on the musical tone signals that have been input to each of channels 2 and 3. By operating the output destination selection operators 214, the output signals may be outputted to three destinations at the same time: to the woofer 12 and tweeter 22, to the headphones, and to an external device that has been connected to the line out. Alternatively, the output signals may be outputted to two destinations at the same time: to the woofer 12 and tweeter 22, and to the headphones. Furthermore, the output signals may be outputted to only one destination: to the headphones.

In addition, on the right side (facing the control panel 21) equalizer operators 215 are provided. The equalizer operators 215 separately adjust the bass, middle and treble tone qualities for the reproduced sound resulting from the mixing of the musical tone signals that have been input to each of the channels. Further provided is the master volume adjusting operator 216. Master volume adjusting operator 216 adjusts the volume of the reproduced sound resulting from the mixing.

Figure 3:
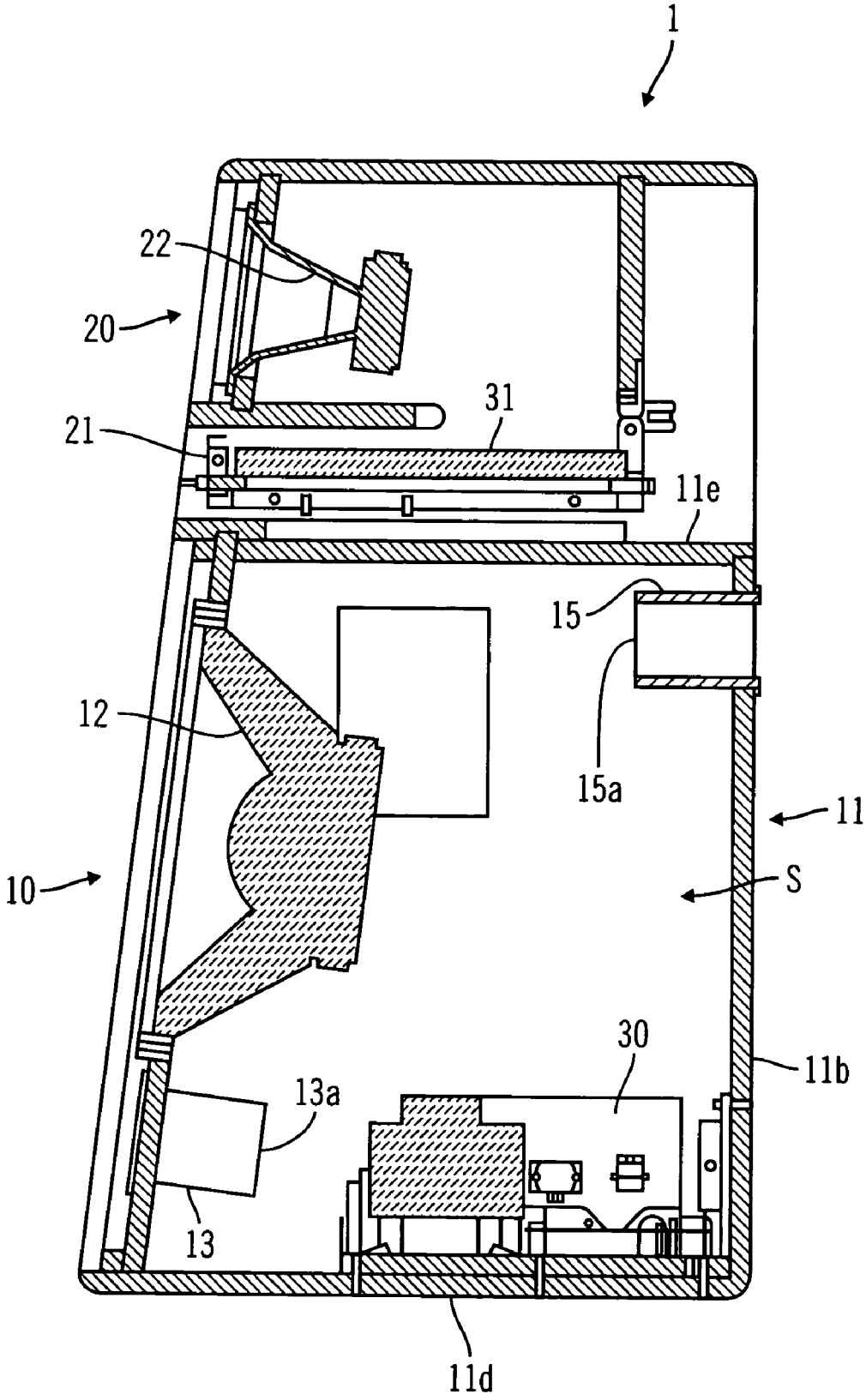
FIG. 3 is a lateral drawing of a vertical cross-section of the speaker system shown in FIG. 1, centered on the direction of the width, according to embodiments of the present invention.

The internal structure of the speaker system 1 shown in FIG. 1 will now be described with reference to FIG. 3. FIG. 3 is a lateral view of a vertical cross-section of the speaker system 1 shown in FIG. 1. The vertical cross-section is centered along the direction of the width of the speaker box 11.

The interior air space S of the speaker box 11 having the woofer section 10 is a single continuous air space and is not partitioned into a plurality of spaces. A power amplifier 30 having an electric power source is arranged in the interior air space S. Thus, the power amplifier 30 is arranged in the same interior air space S in which the woofer 12 is deployed, rather than being arranged in a partitioned air space dedicated to the power amplifier 30. Accordingly, within the woofer section 10, the air space in which the woofer 12 is deployed does not become smaller as a result of partitioning, and it is possible to achieve satisfactory acoustic characteristics.

As shown in FIG. 1, the woofer section 10 has two bass reflex ports 13. The two bass reflex ports 13 have openings 13*a* facing the interior air space S of the speaker box 11. The power amplifier 30 may be arranged on the lower surface 11*d* of the speaker box 11, in the proximity of the rear surface 11*b*, such that the power amplifier 30 faces the openings 13*a* of the two bass reflex ports 13. Because the power amplifier is located on the lower surface 11*d* of the speaker box 11 in this manner, the overall weight balance of the speaker system 1 is improved. The power amplifier 30 may be secured to the lower surface 11*d*, for example, through the use of fasteners.

Still referring to FIG. 3, in the speaker system 1, preamp 31 may be deployed behind the control panel 21 of tweeter section 20 of the speaker system 1. This is a suitable location for the preamp 31, because the preamp 31 may not itself generate heat sufficient to cause a failure or improper operation of the preamp 31.

In the speaker system 1, the preamp 31 and the power amplifier 30 work together and drive both the woofer 12 and the tweeter 22. A coupler (not shown) such as, but not limited to, a cable, may couple the preamp 31 to the power amplifier 30. Also, couplers (not shown) such as, but not limited to, cables, may electrically couple the power amplifier 30 to the woofer 12 and the tweeter 22.

Heat radiation port 15 may be located on the rear surface 11*b* of the speaker box 11 having the woofer section 10. Heat radiation port 15 has an opening 15*a* facing the interior air space S of the speaker box 11 and providing an opening to the outside from the interior of the speaker box 11. Heat radiation port 15 is located in the vicinity of the upper surface 11*e* and is centered on rear surface 11*b* relative to the direction of the width of the lower surface 11*d*. In other words, heat radiation port 15 is in a location that is higher than the bass reflex ports 13. In addition, according to embodiments of the present invention, the opening 15*a* of the heat radiation port 15 is positioned directly above the power amplifier 30.

The length and diameter of heat radiation port 15 are such that only an extremely low sound range, from among the sound ranges that can be reproduced, is used. Thus, heat radiation port 15 has minimum effect on the audio characteristics of the woofer 10. As a result, the audio characteristics of the woofer 10 remain substantially the same as they would be in the absence of the heat radiation port 15.

According to the first preferred embodiment of the woofer section 10 described above, the entry and exit of air from both of the two bass reflex ports 13, as well as from the heat radiation port 15, is produced by driving of the woofer 12. The air that is outside of the speaker box 11, which flows in through both of the two bass reflex ports 13, is directed at the power amplifier 30 and cools the power amplifier 30. Thus, the two bass reflex ports 13 function as air inflow ports. In addition, air inside the interior air space S, which has a high temperature due to the heat generated by the power amplifier 30, rises above the power amplifier 30 and flows through the heat radiation port 15 to the outside of the speaker box 11. Thus, heat radiation port 15 functions as an air outflow port. Furthermore, a flow path is maintained from the bass reflex ports 13 to the power amplifier 30 to the heat radiation port 15 even when the woofer 12 is not being driven.

According to the first preferred embodiment of the woofer section 10 described above, one heat radiation port 15 is arranged on the rear surface 11*b* of the speaker box 11*b*. However, the location of the heat radiation port 15 is not limited to the rear surface 11*b*. For example, according to other embodiments of the present invention, heat radiation port 15 may also be on the left or right side surfaces 11*c*.

Furthermore, as long as there is no change in the audio characteristics, a plurality of heat radiation ports 15 may be located on rear surface 11*b* and/or left or right side surfaces 11*c*. In addition, the closer the opening 15*a* is to the position directly above the power amplifier 30, the more efficiently the heat that is in the interior air space S can be radiated. However, the position of the opening 15*a* is not limited to the location directly above the power amplifier 30. For example, in those cases where two heat radiation ports 15 are arranged, the two heat radiation ports 15 may each be arranged such that the air space directly above the power amplifier 30 is enclosed between openings 15*a* of the two heat radiation ports 15.

A second preferred embodiment of the present invention will now be described with reference to FIG. 4, FIG. 5 and FIG. 6, in which like reference numbers represent corresponding parts. According to the first preferred embodiment described above, the power amplifier 30 is deployed opposite the opening 13*a* of the bass reflex ports 13. In contrast, according to the second preferred embodiment, power amplifier 133 is deployed on a main air flow path that flows between a lower bass reflex port 113 and an upper bass reflex port 115.

Figure 4:
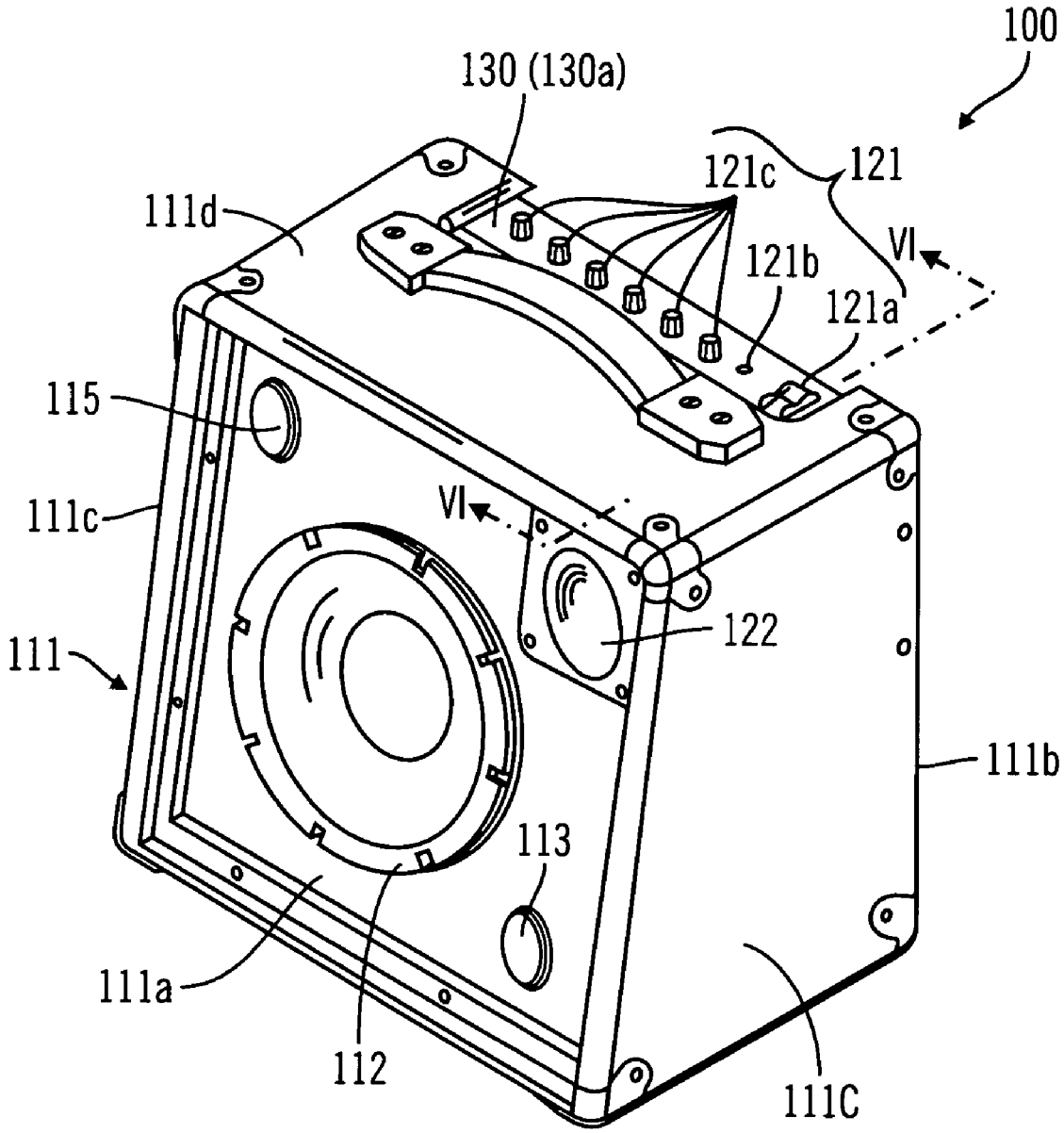
FIG. 4 is an oblique view of the exterior of the speaker system, according to embodiments of the present invention.

FIG. 4 is an oblique view of the exterior of the speaker system 100, according to the second preferred embodiment of the present invention, and shows the profile of the speaker system 100 viewed diagonally from above the front surface of the speaker system 100.

The speaker system 100 is a speaker system with which the output of an electrical or electronic musical instrument is amplified and radiated into the outside space. For example, the electrical or electronic musical instrument may be an electric guitar, a synthesizer, an electronic piano and the like. Alternatively, the electrical or electronic musical instrument may be an audio device such as a microphone amplifier, a mixer and the like. The system includes the speaker box 111, the woofer 112, the tweeter 122 and the control panel 121.

The speaker box 111 forms the frame of the speaker system 100. As in the first preferred embodiment, speaker box 111 comprises an interior air space S (FIG. 6). The speaker box 111 includes a slightly slanted front surface 111*a* (which is formed in a substantially rectangular shape), a rear surface 111*b*, which is opposite the front surface 111*a*, and a pair of side surfaces 111*c*. The speaker box 111 further includes and upper surface 111*d* and lower surface 111*e* (FIG. 6) which form upper and lower sections. The space that is surrounded by all of these surfaces is referred to as interior air space S (FIG. 6).

The woofer 112 is a speaker that is primarily used to reproduce the low frequencies audio and, as shown in FIG. 4, is located in approximately the center area of the front surface 11*a*. Tweeter 122 is a speaker primarily for the reproduction of the high frequencies audio and, as shown in FIG. 4, is located to the right of and above the woofer 112 viewed from the front of the speaker box 111.

In addition, on the front surface 111*a*, the lower bass reflex port 113 is located to the right and below the woofer 112 (closer to the lower surface 111*e* than is the woofer 112) viewed from the front of the speaker box 111. Furthermore, upper bass reflex port 115 is located to the left above the woofer 112 viewed from the front of the speaker box 111 (i.e., closer to the upper surface 111*d* than is the woofer 112).

Lower bass reflex port 113 and upper bass reflex port 115 are components that have the same roles as, respectively, the bass reflex port 13 and the heat radiation port 15 in the first preferred embodiment described above. Together with determining the audio characteristics of the speaker system 100, lower bass reflex port 113 and upper bass reflex port 115 are components for the radiation of the heat in the interior air space S (FIG. 6) to the outside of the speaker box 111.

Specifically, the lower and upper bass reflex ports 113 and 115 each have specified inner diameters and are formed in a cylindrical shape to provide an opening to the outside from the inside (the interior air space S) of the speaker box 111. It is possible to tune the audio characteristics of the speaker system 100 by changing the inner diameter and length of the cylinder. In addition, the heat from the interior air space S can be radiated to the outside through the cylindrical sections. The details of this heat radiation method will be discussed later.

The control panel 121, as shown in FIG. 4, is arranged on a portion of the upper surface 111*d* of the speaker box 111. In the same manner as in the first preferred embodiment, a plurality of operators, switches and the like are provided on the control panel 121. The power switch 121*a* is a switch that is operated to turn the speaker system 100 on or off. The headphone jack 121*b* and the operator group 121*c* are each arranged laterally from the power switch 121*a*. The functions of the operator group 121 are similar to those of operators 211, 212, 213, 214, 215 and 216 described above in relation to the first preferred embodiment, and further description of operator group 121 has been omitted.

Figure 5:
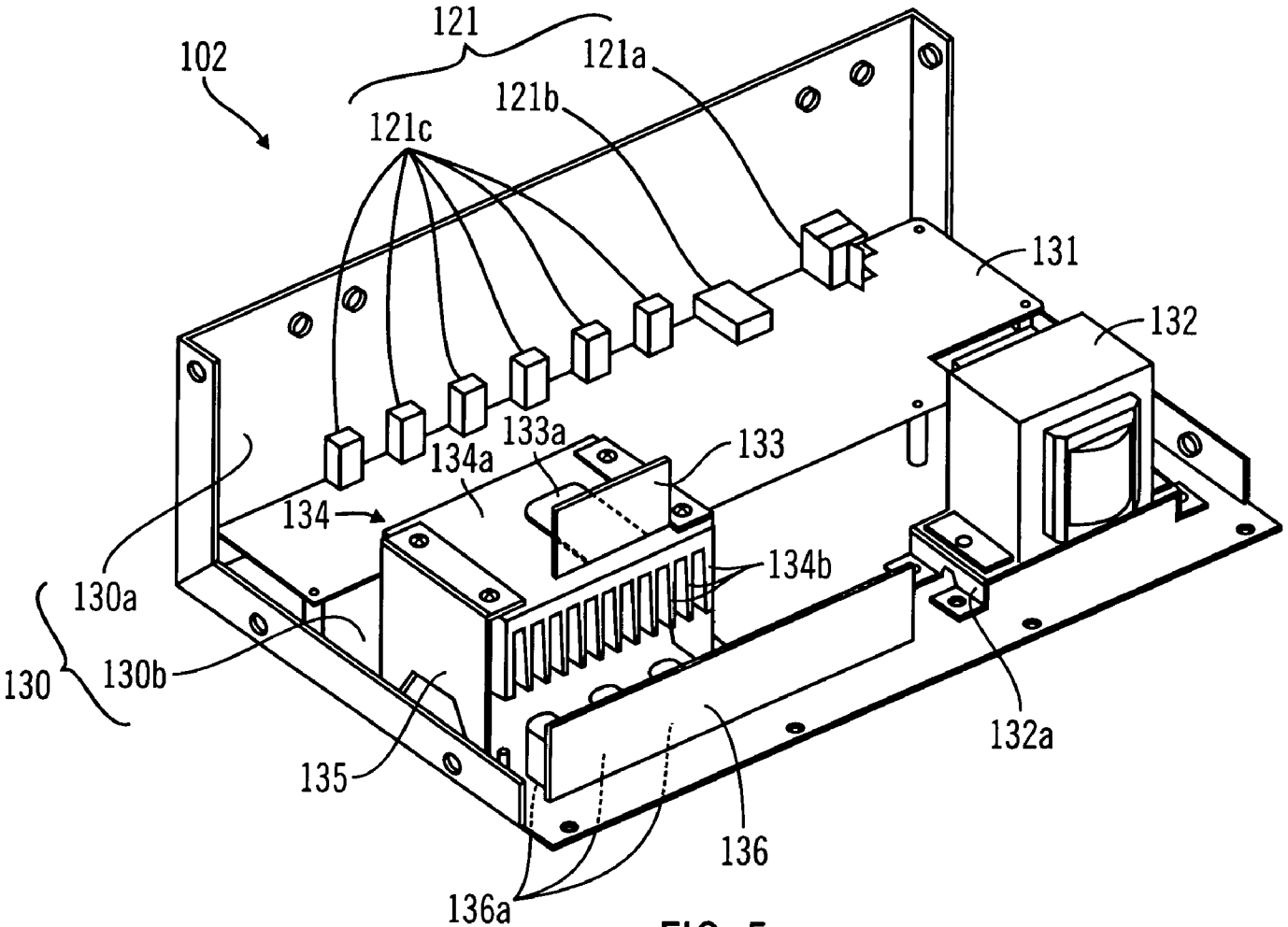
FIG. 5 is an oblique view that shows the internal configuration of the circuit unit, according to embodiments of the present invention.

FIG. 5 is an oblique view showing the internal configuration of circuit unit 102. Couplers (not shown) such as, but not limited to, cables, may electrically couple various components of the circuit unit 102.

The circuit unit 102 is a unit for driving and controlling the speaker system 100 (the woofer 112 and the tweeter 122) based on input signals and the settings of operators in operator group 121*c*. The circuit unit 102, as shown in FIG. 5, includes main board 131, transformer 132, power amplifier 133, jack board 136, and the like, located on the chassis 130.

The chassis 130 is mounted on a corner portion at which the upper surface 111*d* and the rear surface 111*b* of the speaker box 111 intersect and forms a portion of the structures of the upper surface 111*d* and the rear surface 111*b*. The chassis is formed from a flat plate member comprising a metal material that has been bent into a substantially "L" shaped cross-section to form first plate 130*a* and second plate 130*b*, as shown in FIG. 5. The chassis 130 is mounted in the speaker box 111 such that the first plate 130*a* and the second plate 130*b* configure a portion of the upper surface 111*d* and the rear surface 111*b*, respectively, of the speaker box 111 (FIG. 4 and FIG. 6). Accordingly, the control panel 121 described above (FIG. 4) is part of a reverse side surface of the first plate 130*a*. The reverse side surface of the first plate 130*a* is the side in FIG. 5 that faces into the paper.

According to the second preferred embodiment of the present invention, manual operator portions of the power switch 121*a*, the headphone jack 121*b*, the operator group 121*c* (for example, knobs, buttons, toggle switches and the like) may be located on the reverse side surface of the first plate 130*a* (in other words, the control panel 121 shown in FIG. 4). The manual operator portions of the power switch 121*a*, the headphone jack 121*b*, the operator group 121*c* may be mechanically coupled to corresponding electronic component portions (for example, potentiometers, electronic switches and the like) located in the proximity of a forward side surface of the first plate 130*a* (FIG. 5). The forward side surface of the first plate 130*a* is the side in FIG. 5 that faces away from the paper. The electronic component portions of the power switch 121*a*, the headphone jack 121*b*, the operator group 121*c* may be electrically coupled to main board 131.

The main board 131 is the primary circuit board for driving and controlling the speaker system 100 (the woofer 112 and the tweeter 122). The main board 131 may comprise, inter alia, a preamp circuit and the electronic component portions of the power switch 121*a*, the headphone jack 121*b*, the operator group 121*c* and the like that were discussed above. As shown in FIG. 5, the main board 131 is located on the second plate 130*b* of the chassis 130 in the proximity of the first plate 130*a* side.

Transformer 132 transforms an input voltage to a voltage value suitable for driving the speaker system 100. As shown in FIG. 5, transformer 132 may be located on the second plate 130*b* of the chassis 130 on one side of the main board 131. Transformer 132 may be attached to the second plate 130*b*, for example by means of the fixing member 132*a*.

According to the second preferred embodiment of the present invention, transformer 132 may be located a specified distance (for example, approximately 10 millimeters (mm)) above the second plate 130*b* of the chassis 130 by fixing member 132*a*. In this manner, a predetermined air gap is formed between the bottom surface of transformer 132 and the second plate 130*b* of the chassis 130. As a result, a direct transfer of the heat of transformer 132 to the chassis 130 is prevented, and it is possible to minimize the possibility that the chassis 130 will become excessively heated.

In addition, the air gap between the bottom surface of transformer 132 and the second plate 130*b* of the chassis 130 may be utilized as an air flow path. As a result, as will be discussed later, when the air flow in the interior air space S rises, the rising air flow can pass without obstruction through the air gap. Thus, it is possible to efficiently cool the transformer 132 and the second plate 130*b* and to increase the heat radiation efficiency.

According to the second preferred embodiment of the present invention, power amplifier 133 is located to one side of transformer 132. Power amplifier 133 is a circuit board and may be electrically coupled to a power amplifier element 133*a*. The power amplifier 133 outputs to the speakers (the woofer 112 and the tweeter 122) an input signal that has been amplified by means of the power amplifier element 133*a*.

A large amount of heat is produced by the power amplifier element 133*a* during operation of the power amplifier 133. As shown in FIG. 5, according to embodiments of the present invention, in order to increase dissipation of this heat, one side of the power amplifier element 133*a*, formed as a flat surface, is arranged tightly against heat transmission surface 134*a* of heat sink 134. In one embodiment, the flat surface of power amplifier element 133*a* may be fastened or otherwise mounted to heat transmission surface 134*a*. As a result of this tight contact, heat transmission efficiency from the power amplifier element 133*a* to the heat sink 134 is increased. Thus, the possibility of an excessive rise in the temperature of power amplifier element 133*a* is minimized and its electrical characteristic reliability may be increased.

The heat sink 134 is, as discussed above, a component for increasing the heat radiation efficiency of the power amplifier 133 (i.e., the power amplifier element 133*a*). The heat sink 134 is constructed from a metal material such as, but not limited to, iron, aluminum, copper and the like. In one preferred embodiment, the metal is aluminum. The heat sink 134 comprises the heat transmission surface 134*a* and fins 134*b* (FIG. 5).

The heat transmission surface 134*a* is a member for absorbing the heat generated from the power amplifier element 133*a*. As shown in FIG. 5, according to the second preferred embodiment of the present invention, heat transmission surface 134*a* may be configured in a planar shape. By having a planar shape, heat transmission surface 134*a* can be arranged tightly against the flat surface of the power amplifier element 133*a*, increasing the heat transmission efficiency between heat transmission surface 134*a* and the flat surface of the power amplifier element 133*a*. In addition, a plurality of fins 134*b* may be located on a surface on a reverse side of the heat transmission surface 134*a*. The plurality of fins 134*b* function as an expanded heat transmission surface with which the heat that has been absorbed by the heat transmission surface 134*a* can be efficiently diffused into the surrounding air.

Each of the plurality of fins 134*b* may be formed as a plate having a specified thickness. Furthermore, each of the plurality of fins 134*b* may be arranged standing mutually parallel with, and separated by a specified interval from, an adjacent one of the plurality of fins 134*b*, as shown in FIG. 5. As a result of this configuration, a plurality of gaps are formed between opposing surfaces of each of the plurality of fins 134*b*. Each of the plurality of gaps is configured to expose a portion of the bottom side surface of the heat sink 134 (the reverse side surface of the heat transmission surface 134*a*) and two side surfaces of the plurality of fins 134*b* to the surrounding air. In addition, the heat sink 134, as shown in FIG. 5, is arranged on the second plate 130*b* such that the gaps on one of two exposed side surfaces are facing toward the first plate 130*a* and the gaps on the other of the two exposed side surfaces is facing in a direction opposite the first plate 130*a*.

Figure 6:
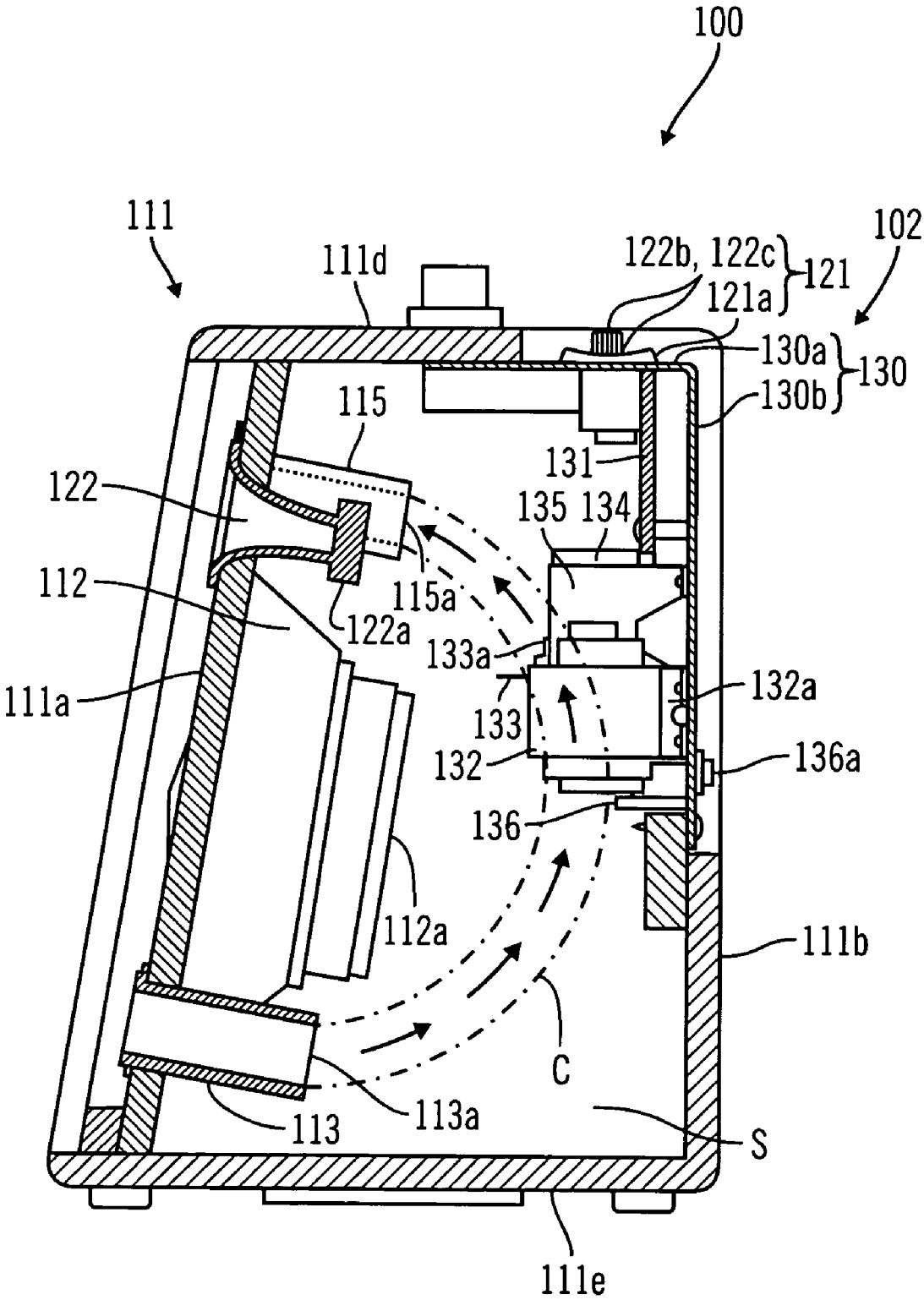
FIG. 6 is a side cross-section view of the speaker system 100 along the line VI—VI of FIG. 4, according to embodiments of the present invention.

As discussed above, the first plate 130*a* of chassis 130 (the circuit unit 102) is located on the upper side (the upper surface 111*d* side) on the speaker box 111 (FIG. 4 and FIG. 6). As a result, heat sink 134 is oriented such that the gaps in the two exposed side surfaces of the plurality of fins 134*b* face in upward and downward directions in the interior air space S of the speaker box 111. In other words, the gaps in one of the two exposed side surfaces of the plurality of fins 134*b* face in the direction of the upper surface 111*d* of the speaker box 111. The gaps in the other of the two exposed side surfaces of the plurality of fins 134*b* face in the direction of the lower surface 111*e* of the speaker box 111.

As will be discussed in more detail later, this orientation of the heat sink 134 maintains, for a rising air flow within interior air space S, an air flow convection path between the lower and upper facing gaps. As a result, because the rising air flow passes through the lower and upper facing gaps without obstruction, the heat sink 134 can be efficiently cooled by the rising air flow. Thus, it is possible to further increase the heat radiating efficiency of the power amplifier 133.

Furthermore, according to embodiments of the present invention, the heat sink 134 may be located a specified distance (for example, approximately 30 mm) above the second plate 130*b* of the chassis 130 by a fixing member 135 (FIG. 5). In this manner, a predetermined air gap is formed between the bottom surface of the heat sink 134 and the second plate 130*b* of the chassis 130. As a result, a direct transfer of the heat from the heat sink 134 to the chassis 130 is prevented, and the possibility that the chassis 130 will become excessively heated is minimized.

In addition, as a result of locating the heat sink 134 above the second plate 130*b* of the chassis 130, other components may be arranged in the proximity of the heat sink 134 without obstructing the air flow between the lower and upper facing gaps. Thus, the space available for locating components on the second plate 130*b* may be utilized more effectively.

As shown in FIG. 5, jack board 136 is located on one side of the heat sink 134 on the second plate 130*b*. Jack board 136 is a circuit board for providing input signals to the main board 131. The input signals are received by jack board 136 from outside the speaker system 100 via input jacks 136*a*. Input jacks 136*a* function as input terminals and are exposed on the reverse side surface of the second plate 130*b*. The reverse side surface of the second plate 130*b* is the side in FIG. 5 that faces into the paper. Because second plate 130*b* forms a portion of the structure of the rear surface 111*b*, input jacks 136*a* are also exposed to outside of the speaker box 111 at the rear surface 111*b* (FIG. 6). Although not shown, couplers such as, but not limited to, cables, may be used for electrically coupling the various components shown in FIG. 6 and discussed above.

FIG. 6 shows a side cross-section view of speaker system 100 taken along the line VI—VI shown in FIG. 4. The two dotted lines in FIG. 6 are lines that depict schematically a convection path C or "main path" of the air flow in the interior air space S. The plurality of arrows indicate the direction of the air flow in the convection path C. The convection path C depicted schematically in FIG. 6 represents a path in the interior air space S where it is assumed that the movement (the amount of flow) of the air is the greatest. However, there are also various air flow convection paths other than the convection path C that exist within the interior air space S.

As shown in FIG. 6, the speaker box 111 is configured as a substantially hollow box shape having an interior air space S. Woofer 112 is approximately centered in a vertical direction of the slightly slanted front surface 111*a* (i.e., the vertical direction in FIG. 6). The lower and upper bass reflex ports 113, 115, which provide an opening to the outside from within the interior air space S, are respectively located below and above the woofer 112.

Furthermore, as discussed above, the lower and upper bass reflex ports 113, 115 are arranged respectively on lower right and upper left edge areas of the front surface 111*a* (FIG. 4). In other words, they are located such that a straight line drawn from the center of one to the center of the other would form a diagonal line across the front surface 111*a*. By arranging the lower and upper bass reflex ports 113, 115 along a diagonal line of the front surface 111*a* in this manner, it is possible to produce a longer convection path C in the interior air space S. As will be discussed in more detail later, a longer convection path C allows the air in the interior air space S to be efficiently agitated, which results in a uniform flow to the outside of the air in the interior air space S. In this manner, it is possible to prevent the air from becoming stagnant in a portion of the interior air space S.

As has been discussed above, the chassis 130 (the circuit unit 102) is mounted at a corner portion where the upper surface 111*d* and the rear surface 111*b* of the speaker box 111 intersect (the upper right portion in FIG. 6). As a result, the various electronic components, transformer 132, heat sink 134 and the like arranged on the first and second plates 130*a*, 130*b*, are arranged within the interior air space S.

As shown in FIG. 6, transformer 132, power amplifier 133, and heat sink 134 are arranged further towards the rear of the interior air space S (i.e., further towards the rear surface 111*b* side in FIG. 6) than the openings 113*a* and 115*a* of the lower and upper bass reflex ports 113 and 115. In addition, transformer 132, power amplifier 133, and heat sink 134 are arranged above opening 113*a* of the lower bass reflex port 113 (i.e., closer to upper surface 111*d*) and below opening 115*a* of the upper bass reflex port 115 (i.e., closer to lower surface 111*e*). As a result of their location, transformer 132, power amplifier 133, and heat sink 134 are arranged in the convection path C, which is the primary route along which the air passes.

A heat radiation mechanism of the speaker system 100, according to embodiments of the present invention, will now be described.

When the electric power of the speaker system 100 is turned on (for example, by means of the power switch 121*a*), transformer 132 and power amplifier 133 are driven. As a result, transformer 132 and power amplifier 133 (power amplifier element 133*a*) generate heat. Due to this heat generation, the temperature within the interior air space S increases. In addition, in those cases where there is sound emission by the woofer 112 and the tweeter 122, heat is also produced by the coil sections 112*a* and 122*a* of woofer 112 and tweeter 122. This heat from coil sections 112*a* and 122*a* further increases the temperature within the interior air space S.

Because transformer 132 and power amplifier 133 are, as discussed above, arranged below the upper bass reflex port 115, the air that is warmed by the heat produced by these components and others rises within the interior air space S. The rising air flows into the upper bass reflex port 115 through the opening 115*a* and flows out of the speaker box 111 to the outside via the upper bass reflex port 115.

In addition, as air flows out from the upper bass reflex port 115, outside air flows into the interior air space S from the opening 113*a* via the lower bass reflex port 113. Because, as discussed above, transformer 132 and power amplifier 133 are arranged above lower bass reflex port 113, the air that flows into the interior air space S from outside via the lower bass reflex port 113 rises toward the transformer 132 and the power amplifier 133 in the interior air space S.

As a result, as shown in FIG. 6, a generally diagonally curving air flow convection path C is formed in the interior air space S such that air flows from the opening 113*a* of the lower bass reflex port 113 toward the opening 115*a* of the upper bass reflex port 115. Therefore, the heat within the interior air space S is exhausted (radiated) to the outside by the air flow and outside air is efficiently introduced into the interior air space S. This makes it possible to reliably limit the temperature increase in the interior air space.

Furthermore, transformer 132, power amplifier 133 (the power amplifier 133*a*) and heat sink 134 are advantageously arranged in the convection path C (FIG. 6). Transformer 132, power amplifier 133 (the power amplifier 133*a*) and heat sink 134 are the heat sources that cause the greatest increase in the temperature in the interior air space S. However, because they are located in the convection path C, it is possible to improve the heat radiation efficiency of these and other components by means of the air cooling action of the air flow in the convection path C. The heat radiated from these and other components can be reliably made to flow to the opening 115*a* by means of the air flow of the convection path C from the lower bass reflex port 113 to the upper bass reflex port 115. This air flow passes by the transformer 132, power amplifier 133 (the power amplifier 133*a*) and heat sink 134, as well as other components. As a result, it is possible to efficiently exhaust (radiate) the heat in the interior air space S to the outside from the upper bass reflex port 115.

In addition, the heat sink 134, as described above, is oriented in the interior air space S of the speaker box 111 such that the gaps in the two exposed side surfaces of the plurality of fins 134*b* are oriented in the vertical direction (the vertical direction in FIG. 6). Therefore, because the air flow that rises in the interior air space S passes through the gaps between each of the plurality of fins 134*b*, the heat sink 134 is efficiently cooled by the rising air flow, and it is possible to further improve the heat radiation efficiency of the power amplifier 133.

In addition, by passing through the gaps between each of the plurality of fins 134*b*, the rising air flow is unobstructed. Thus, it is possible to maintain the air flow convection path C and reliably limit the temperature increase in the interior air space S.

It is to be understood that even though numerous characteristics and advantages of embodiments of the present invention have been set forth in the foregoing description, together with details of the structure and function of embodiments of the invention, this disclosure is illustrative only. Changes may be made in detail, especially matters of structure and management of parts within the principles of the present invention to the full extent indicated by the broad general meaning of the terms in which the appended claims are expressed.

For example, according to the second preferred embodiment, the upper and lower bass reflex ports 115 and 113 in the speaker system 100 are arranged on the front surface 111*a* of the speaker box 111. However, in other embodiments, one or both of the upper and lower bass reflex ports 115 and 113 may be, for example, arranged on the rear surface 111*b* or the side surfaces 111*c*, while still achieving the heat radiation efficiency discussed above.

Such alternative arrangements of the upper and lower bass reflex ports 115 and 113 are possible because the sounds that are emitted from the upper and lower bass reflex ports 115 and 113 are low frequency sounds that have hardly any directivity. Thus, the upper and lower bass reflex ports 115 and 113 may be arranged on any one of the front surface 111*a*, the rear surface 111*b* or the side surfaces 111*c*, without detriment to the audio characteristics.

In addition, according to the second preferred embodiment, the heat sink 134 in the speaker system 100 is oriented in the interior air space S of the speaker box 111 such that the gaps in the two exposed side surfaces of the plurality of fins 134*b* are oriented in the vertical direction. However, in other embodiments, the heat sink 134 may be otherwise oriented. For example, in one embodiment the heat sink 134 may be oriented in the speaker box 111 such that the gaps in the two exposed side surfaces of the plurality of fins 134*b* are oriented in a generally diagonal direction with respect to a vertical line drawn between the upper surface 111*d* and the lower surface 111*e* of the speaker system 111. In this manner, the gaps may conform to the direction of progression of the convection path C from the opening 113*a* of the lower bass reflex port 113 toward the opening 115*a* of the upper bass reflex port 115.

More specifically, as discussed above, the convection path C begins on the bottom right of the speaker box 111 (lower bass reflex port 113) and progresses to the upper left of the speaker box 111 (upper bass reflex port 115) (FIG. 4 and FIG. 6). As a result, convection path C progresses through the interior air space S of the speaker box 111 in a generally diagonally curving direction of flow from the lower right toward the upper left of the speaker box 111. Accordingly, the heat sink 134 shown in FIG. 5 may be rotated counter clockwise on the second plate 130*b* of the chassis 130 between approximately 30° and 60° in order to maximize the air flow passing through the gaps between each of the plurality of fins 134*b*.

Having disclosed exemplary embodiments and the best mode, modifications and variations may be made to the disclosed embodiments while remaining within the scope of the invention as defined by the following claims.

What is claimed is:

1. In a speaker system having a speaker box defining an interior air space, the speaker box having a speaker arranged within the interior air space, a method of efficiently radiating heat from the interior air space to outside the speaker box, comprising:

providing at least one air inflow port on a first surface of the speaker box, the at least one air inflow port opening to outside of the speaker box from the interior air space;

providing at least one air outflow port on a second surface of the speaker box, the at least one air outflow port opening to outside of the speaker box from the interior air space; and arranging a heat producing component relative to the speaker within the interior air space such that air entering the interior air space from outside the speaker box via the at least one air inflow port is directed towards the heat producing component and such that heat radiated from the heat producing component rises above the speaker in the interior air space before exiting to outside the speaker box via the at least one air outflow port.

2. The method recited in claim 1, wherein the heat producing component is an amplifier for driving the speaker.

3. The method recited in claim 1, wherein the at least one air inflow port is a bass reflex port and wherein acoustic characteristics of the speaker system are tuned using the at least one air inflow port.

4. The method recited in claim 1, wherein the at least one air inflow port comprises two or more air inflow ports.

5. The method recited in claim 1, wherein the speaker is arranged on the first surface.

6. The method recited in claim 1, wherein the first surface is a slanted surface.

7. The method recited in claim 6, wherein the speaker is arranged slightly above a vertical center of the slanted surface and wherein the at least one air inflow port is arranged below the vertical center.

8. The method recited in claim 1, wherein the at least one air inflow port comprises two air inflow ports and wherein one of the two air inflow ports is arranged on a left edge of the first surface and another of the two air inflow ports is arranged on a right edge of the first surface.

9. The method recited in claim 1, wherein the interior air space is a single continuous air space.

10. The method recited in claim 1, wherein the second surface opposes the first surface.

11. The method recited in claim 1, wherein providing at least one air outflow port further comprises selecting a length and a diameter of the at least one air outflow port such that the at least one air outflow port has substantially no effect on audio characteristics of the speaker system.

12. The method recited in claim 1, wherein an air flow between the at least one air inflow port and the at least one air outflow port is produced by driving the speaker.

13. The method recited in claim 12, wherein the air flow path is maintained when the speaker is not being driven.

14. The method recited in claim 1, wherein the speaker is a woofer for reproducing primarily low frequency sounds, and wherein the speaker box is a woofer section of a speaker system.

15. The method recited in claim 14, further comprising a tweeter section adjoining the woofer section, the tweeter section comprising:

a tweeter for reproducing primarily high frequency sounds; and a preamplifier for driving the tweeter and the woofer.

16. The method recited in claim 15, wherein a height of the tweeter in the speaker system is substantially the same as a height at which electronic cymbals are arranged in an actual drum set.

17. The method recited in claim 15, further comprising a control panel for adjusting settings for the preamplifier and for an amplifier.

18. The method recited in claim 17, wherein the control panel comprises:

a plurality of input channels for inputting musical tones for mixing by the amplifier; and a plurality of operators for adjusting parameters of the speaker system.

19. The method recited in claim 18, wherein at least one of the plurality of input channels is for inputting musical tone signals that have been produced by a performance on an electronic percussion instrument.

20. The method recited in claim 18, wherein the parameters comprise at least one of channel volume, master volume, tone qualities for reproduced sounds, and output destinations for output signals based on musical tone signals that have been input to at least one of the plurality of input channels.

21. In a speaker system having a speaker box defining an interior air space, the speaker box having a speaker arranged within the interior air space, a method of efficiently radiating heat from the interior air space to outside the speaker box, comprising:

providing an air inflow port in the speaker box, the air inflow port opening to outside of the speaker box from the interior air space;

providing an air outflow port in the speaker box, the air outflow port opening to outside of the speaker box from the interior air space;

arranging the air inflow port and the air outflow port in the speaker box such that an air flow path through the speaker box is formed; and arranging a heat producing component within the interior air space such that the heat producing component is within the air flow path and is in a location that is either between the air inflow port and the air outflow port or is linearly aligned with at least one of a central axis of the air inflow port in a direction of air flow into the air inflow port and a central axis of the air outflow port in a direction of air flow out of the air outflow port.

22. The method recited in claim 21, wherein the heat producing component is an amplifier for driving the speaker.

23. The method recited in claim 21, wherein the air inflow port and the air outflow port are bass reflex ports and wherein acoustic characteristics of the speaker system are tuned using at least one of the air inflow port and the air outflow port.

24. The method recited in claim 23, wherein the acoustic characteristics of the speaker system are tuned by changing at least one of an inner diameter and a length of at least one of the air inflow port and the air outflow port.

25. The method recited in claim 21, wherein the speaker box includes a first surface and wherein the speaker is arranged on the first surface.

26. The method recited in claim 25, wherein the air inflow port and the air outflow port are arranged on the first surface.

27. The method recited in claim 26, wherein the air inflow port and the air outflow port are arranged on the first surface such that a straight line drawn from a center of the air inflow port to a center of the air outflow port would form a diagonal line across the first surface.

28. The method recited in claim 21, wherein the air flow path is a generally diagonally curving air flow convection path formed in the interior air space such that air flows from the air inflow port to the air outflow port.

29. In a speaker system having a speaker box defining an interior air space, the speaker box having a speaker arranged within the interior air space, a method of efficiently radiating heat from the interior air space to outside the speaker box, comprising:

providing at least one air inflow port in the speaker box, the at least one air inflow port opening to outside of the speaker box from the interior air space;

providing at least one air outflow port in the speaker box, the at least one air outflow port opening to outside of the speaker box from the interior air space;

arranging the at least one air inflow port and the at least one air outflow port in the speaker box such that an air flow path through the speaker box is formed;

arranging a heat producing component within the interior air space such that the heat producing component is within the air flow path, wherein the heat producing component is an amplifier for driving the speaker; and providing a drive and control unit for driving and controlling the speaker system, the drive and control unit comprising:

a main board including thereon a preamplifier for driving the speaker system and operators for controlling the speaker system;

a transformer for transforming an input voltage to a voltage value suitable for driving the speaker system;

a heat sink for dissipating heat generated by the amplifier;

a jack board for providing input signals to the main board; and a chassis for carrying the main board, the transformer, the amplifier and the jack board.

30. The method recited in claim 29, wherein the chassis is formed from a flat plate member comprising a metal material, the flat plate member formed into a substantially "L" shape and including a first plate and a second plate.

31. The method recited in claim 30, wherein the speaker box includes an upper surface and a rear surface and wherein the chassis is mounted in the speaker box such that the first plate and the second plate configure a portion of the upper surface and the rear surface, respectively, of the speaker box.

32. The method recited in claim 31, wherein a control panel is arranged on the first plate for adjusting settings for the preamplifier and for the amplifier.

33. The method recited in claim 31, wherein the main board, the transformer, the heat sink and the jack board are arranged on the second plate.

34. The method recited in claim 33, wherein the heat sink is arranged a specified distance above the second plate of the chassis such that a predetermined air gap is formed between a bottom surface of the heat sink and the second plate.

35. The method recited in claim 34, wherein the specified distance is approximately 30 millimeters (mm).

36. The method recited in claim 33, wherein the transformer is arranged a specified distance above the second plate of the chassis such that a predetermined air gap is formed between a bottom surface of the transformer and the second plate.

37. The method recited in claim 34, wherein the specified distance is approximately 10 millimeters (mm).

38. The method recited in claim 33, wherein the transformer, the heat sink and the jack board are arranged within the interior air space.

39. The method recited in claim 33, wherein the transformer, the heat sink and the jack board are arranged in the air flow path.

40. The method recited in claim 29, wherein the amplifier is a power amplifier including an amplifying element and wherein the amplifying element contacts a surface of the heat sink.

41. The method recited in claim 40, wherein the surface of the heat sink is a substantially planar surface and wherein the amplifying element includes a flat surface for contacting the planar surface.

42. The method recited in claim 29, wherein the heat sink comprises a plurality of fins functioning as an expanded heat transmission surface of the heat sink, ones of the plurality of fins being arranged standing mutually parallel with, and separated by a specified interval from, adjacent ones of the plurality of fins, such that gaps are formed between opposing faces of the plurality of fins, each of the gaps exposing a portion of a bottom side surface of the heat sink and two side surfaces of the plurality of fins to surrounding air.

43. The method recited in claim 42, wherein the heat sink is oriented within the speaker box such that the air flow path passes through the gaps in the two exposed side surfaces of the plurality of fins.

44. The method recited in claim 42, wherein the speaker box includes an upper surface and a lower surface and wherein the heat sink is oriented within the speaker box such that the gaps in one of the two exposed side surfaces of the plurality of fins face the upper surface and the gaps in the other of the two exposed side surfaces of the plurality of fins face the lower surface such that the air flow path passes through the gaps.

45. The method recited in claim 42, wherein the speaker box includes an upper surface and a lower surface and wherein the heat sink is oriented within the speaker box such that the gaps in the two exposed side surfaces of the plurality of fins are oriented in a generally diagonal direction with respect to a vertical line between the upper surface and the lower surface.

46. The method recited in claim 45, wherein the heat sink is rotated on the second plate such that air flow passing through the gaps between each of the plurality of fins is maximized.

47. The method recited in claim 21, wherein the interior air space is a single continuous air space.

48. The method recited in claim 21, wherein the speaker is a woofer for reproducing primarily low frequency sounds.

49. The method recited in claim 21, wherein the speaker box further includes a tweeter for reproducing primarily high frequency sounds.

50. A speaker system, comprising:

a speaker box defining an interior air space and having at least a first surface and a second surface;

a speaker arranged within the interior air space;

at least one air inflow port on the first surface, the at least one air inflow port opening to outside of the speaker box from the interior air space;

at least one air outflow port on the second surface, the at least one air outflow port opening to outside of the speaker box from the interior air space; and a heat producing component arranged relative to the speaker within the interior air space such that air entering the interior air space from outside the speaker box via the at least one air inflow port is directed towards the heat producing component and such that heat radiated from the heat producing component rises above the speaker in the interior air space before exiting to outside the speaker box via the at least one air outflow port.

51. The speaker system recited in claim 50, wherein the heat producing component is an amplifier for driving the speaker.

52. The speaker system recited in claim 50, wherein the at least one air inflow port is a bass reflex port and wherein acoustic characteristics of the speaker system are tuned using the at least one air inflow port.

53. A speaker system, comprising:

a speaker box defining an interior air space;

a speaker arranged within the interior air space;

an air inflow port in the speaker box, the air inflow port opening to outside of the speaker box from the interior air space;

an air outflow port in the speaker box, the air outflow port opening to outside of the speaker box from the interior air space, the air inflow port and the air outflow port being arranged in the speaker box such that an air flow path through the speaker box is formed; and a heat producing component arranged within the interior air space such that the heat producing component is within the air flow path and is in a location that is either between the air inflow port and the air outflow port or is linearly aligned with at least one of a central axis of the air inflow port in a direction of air flow into the air inflow port and a central axis of the air outflow port in a direction of air flow out of the air outflow port.

54. The method recited in claim 53, wherein the heat producing component is an amplifier for driving the speaker.

55. The method recited in claim 53, wherein the air inflow port and the air outflow port are bass reflex ports and wherein acoustic characteristics of the speaker system are tuned using at least one of the air inflow port and the air outflow port.

56. The method recited in claim 55, wherein the acoustic characteristics of the speaker system are tuned by changing at least one of an inner diameter and a length of at least one of the air inflow port and the air outflow port.

57. The method recited in claim 1, wherein the first surface faces a first direction; and wherein the second surface faces a second direction that is different from the first direction.

58. The method recited in claim 1, wherein the first surface is a front surface of the speaker box; and wherein the second surface is a back surface of the speaker box.

59. The method recited in claim 1, wherein the at least one air inflow port and the at least one air outflow port provide an air flow path within the speaker box from the at least one air inflow port to the at least one air outflow port; and wherein at least a portion of the air flow path is free from obstructions other than the heat producing component.

60. The method recited in claim 1, wherein there are no obstructions between the at least one air inflow port and the heat producing component.

61. The method recited in claim 1, wherein the at least one air inflow port and the at least one air outflow port provide an air flow path within the speaker box from the at least one air inflow port to the at least one air outflow port; and wherein there are no obstructions in the air flow path between the at least one air inflow port and the heat producing component.

62. The method recited in claim 61, wherein there are no obstructions in the air flow path between the heat producing component and the at least one air outflow port.

63. The method recited in claim 1, wherein the interior air space is a single continuous air space.

* * * * *